US005881887A

United States Patent [19]

Fongen

[11] Patent Number: 5,881,887

[45] Date of Patent: Mar. 16, 1999

[54] APPARATUS CALLED "TSS"-THE TURBO SCREENING SYSTEM, FOR FILTERING AND FRACTIONATION OF SUSPENSIONS CONTAINING FIBRES, FIBRE FRAGMENTS, FINES AND OTHER PARTICLES

[76] Inventor: Sigurd Fongen, Eivind Alnaes vei 24, N-1410 Kolbotn, Norway

[21] Appl. No.: 537,670

[22] PCT Filed: Apr. 16, 1993

[86] PCT No.: PCT/NO93/00063

§ 371 Date: Oct. 16, 1995

§ 102(e) Date: Oct. 16, 1995

[87] PCT Pub. No.: WO94/24365

PCT Pub. Date: Oct. 27, 1994

[51] Int. Cl.[6] ..... B07B 1/08; D21D 5/02

[52] U.S. Cl. ..... 209/250; 209/380; 210/327; 210/391; 19/204

[58] Field of Search ..... 209/243, 247, 209/250, 305, 319, 401, 403, 359, 380; 210/327, 391, 780, 797, 798; 19/200, 202, 204, 205

[56] References Cited

U.S. PATENT DOCUMENTS

| | | | |
|---|---|---|---|
| 2,988,223 | 6/1961 | Janson | 209/250 X |
| 4,696,751 | 9/1987 | Eifling | 209/402 X |
| 5,124,029 | 6/1992 | Fjallstrom et al. | 209/250 |

FOREIGN PATENT DOCUMENTS

| | | | |
|---|---|---|---|
| 693671 | 11/1962 | Canada | 209/250 |
| 0 049 022 | 4/1982 | European Pat. Off. . | |
| 164 149 | 12/1985 | European Pat. Off. . | |
| 379711 | 8/1990 | European Pat. Off. | 209/250 |
| 452 904 | 8/1925 | Germany . | |
| 1 771 771 | 1/1972 | Germany . | |
| 108164 | 2/1966 | Norway . | |
| B 368727 | 7/1974 | Sweden . | |
| 716633 | 2/1980 | U.S.S.R. | 209/250 |
| 902 375 | 8/1962 | United Kingdom . | |
| 1 215 864 | 12/1970 | United Kingdom . | |

OTHER PUBLICATIONS

International Search Report dated Dec. 9, 1993.

*Primary Examiner*—William E. Terrell
*Assistant Examiner*—Tuan N. Nguyen
*Attorney, Agent, or Firm*—Kane, Dalsimer, Sullivan et al.

[57] ABSTRACT

The present invention is directed to an electrolytically produced screening material for the removal of fibers from suspensions during the production of pulp and paper. The screening material is a thin, smooth metal foil having perforations on the order of 10–80 $\mu$m. And an open area of 5% to 40%.

8 Claims, 4 Drawing Sheets

APPARATUS CALLED "TSS"-THE TURBO SCREENING SYSTEM, FOR FILTERING AND FRACTIONATION OF SUSPENSIONS CONTAINING FIBRES, FIBRE FRAGMENTS, FINES AND OTHER PARTICLES

1. FIELD OF INVENTION

The invention concerns removal of fibre fragments, fibre fines and other particles from fibre suspensions, for example suspensions formed during the production of pulp and paper.

Fibre fragments, fines and other, minor particles are often undesired in fibre suspensions due to the fact that they hinder paper drainage in the paper machine and thereby reducing the machine's production capacity. Also, fibre fragments and fines in the finished paper reduce the strength of the paper and cause unwanted dusting from the paper web in printing shops.

Fragments and fines also often cause delamination of the paper sheet, which again leads to paper rupture.

Fibre fragments, etc. reduce the paper quality, and may, under circumstances, make the fibre suspension unsuitable for paper production.

These problems are exacerbated by increased consumption of secondary fibres because new fibre fragments and new fines are created from secondary fibres every time they are re-used for the production of paper.

Therefore, there is a great and steadily increasing demand for a suitable apparatus capable of fractionation of fibre suspensions for separating fibre fragments, fines and other, unwanted small particles from fibre suspensions.

Due to the more stringent environmental regulations there will be an increased demand for separation of suspended solids from liquids, in other fields as well.

In addition, the invention is generally applicable for the recovery of fibres and solids from suspensions.

2. STAR OF TECHNOLOGY

The machinery used today for the separation of fibres, fibre fragments and fines from fibre suspensions are constructed as bow screens or as rotating drum- or disc filters.

These filters have various designs and modes of operation, and are less suited for fibre fractionation.

The filtering area of the bow screen consists of many, parallel metal rods packed together at certain, internal intervals, thus forming a relative. smooth filtering surface, whereby the intervals between the rods constitute the perforation or open area of the filtering surface. The filtering areas of the drum- and disc filters are woven clothes of high mesh, usually made out of monofilament threads of synthetic material (plastics), the filtering area rotating slowly within a vat filled with the suspension to be filtered.

The static bow screen functions with the fibre suspension flushing over the filtering area, across the metal rods and their intervals, either by having the suspension flushing over an inclined, bowed surface by its own momentum or being sprayed onto the filtering surface, approximately tangential to the bow's form.

During rotation of the drum and disc filter in the fibre suspension a filtering layer consisting of fibres is formed on the one side of the high-mesh screen cloth through which the filtrate is penetrating. This filtering layer, formed onto the the filtering cloth, consists of fibres from the suspension to be filtered, or can be added to the suspension beforehand, as a so called filtering pulp. With each revolution of the drum- or disc filters, this filtering layer, which contains those fragments and those fines which has been filtered out of the suspension, is washed off the filtering cloth by means of water or air. This filtering layer retains not only the fibres but also fibre fragments and fines. Both drum- and disc filters are therefore suited for socalled barrier screening of fibre suspensions, but less suitable for the fractionation of same.

Due to its relatively coarse, mechanical construction and coarse perforation, the bow screen is not suited for fractionation, as the screen permits too many usable fibres to slip through together with the fragments and the fines which should be separated from the fibre suspension.

3. BRIEF DESCRIPTION OF THE DRAWINGS

4. DESCRIPTION OF THE INVENTION

The invention is a new, perforated screening material, which has not previously been applied in the pulp and paper industry, and which, by virtue of its special characteristics, opens up new opportunities in connection with screening and fractionation of fibre-containing suspensions.

The screening material is electrolyttically produced, as a continuous, thin and smooth metal foil with extremely small perforations, preferably with diameters in the order of 10–80 $\mu$m and a thickness of the foil in relation to the hole diameter on the order of 1:1 or 1,0–1,5:1, and an open area in the order of 5% to 40%.

Thus, the metal foil has, as a screening material, technical dimensions and specifications which are unachievable by today's modes of production for conventional filters, these being bow screens, where the width of the intervals hardly can be less than 150 $\mu$m, or the screen clothes in drum- or disc filters, where the surface is comparatively rough and uneven due to the weaving texture of the cloth, and where the fibres easily get entangled into the woven structure of the cloth, as a conseqence a "fishing net effect".

The screening material of the invention, being a thin metal foil, has a very smooth an even surface. The perforation holes are self cleaning by virtue of their short lengths and round edges, which counteract clogging of the holes.

The construction of the invention can be seen in FIG. 1–7.

Figure 1:
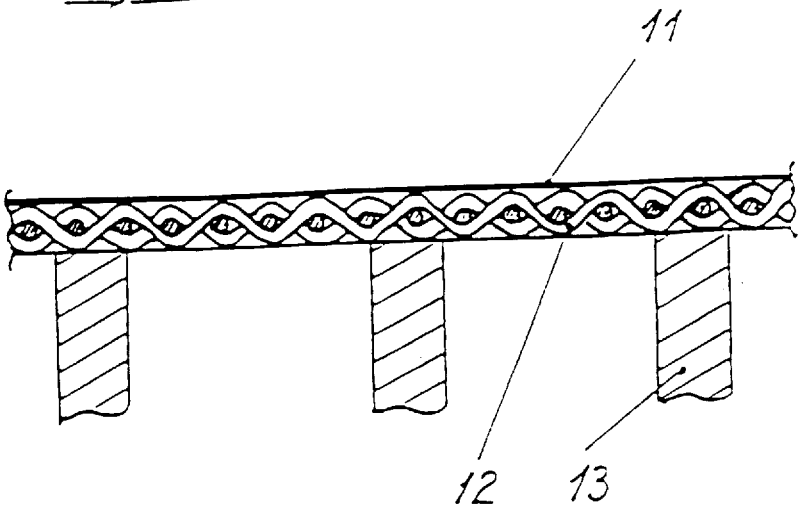
FIG. 1 illustrates the screening material of the present invention.
Figure 2:
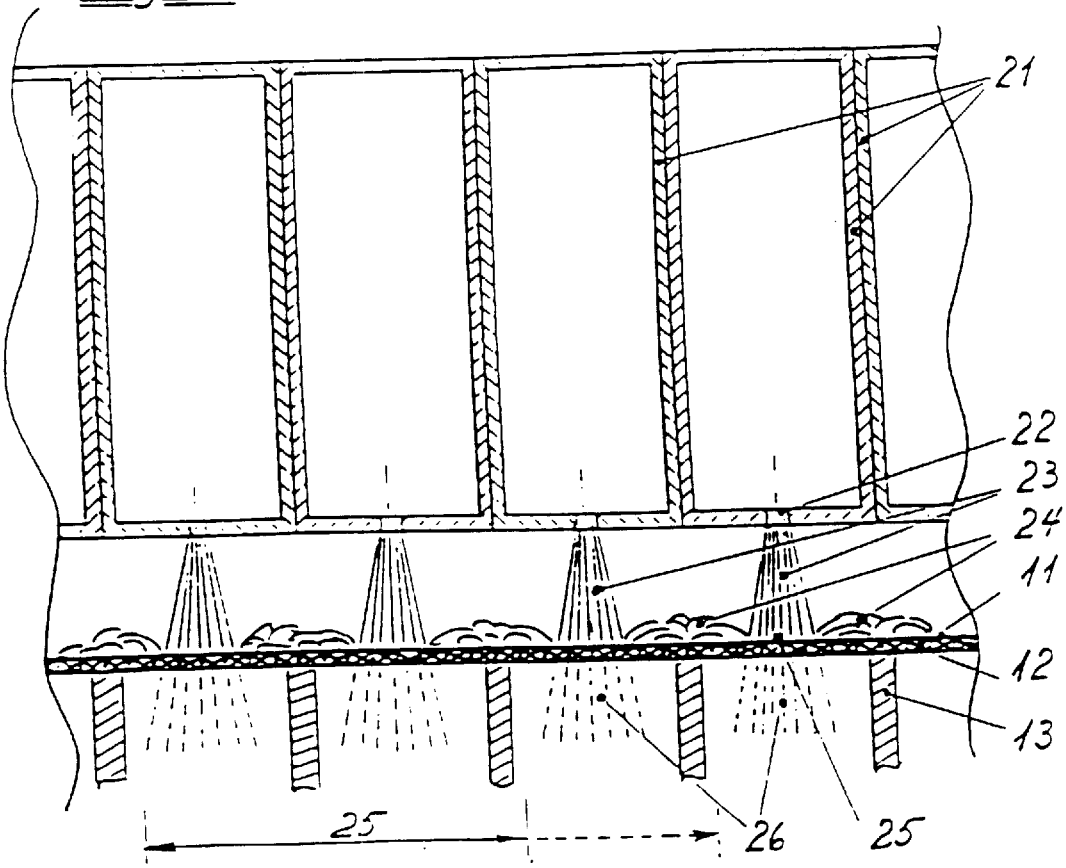
FIG. 2 illustrates aspects of the screening system of the present invention.

The screening material (11, FIG. 1) with its special perforation is attached to an underlying material (12), which has substantially coarser perforation or openings, preferably in the form of a woven texture of comparatively coarse, monofilamnet wires of synthetic material (plastics) or metal, as shown in FIG. 1.

The structure is further attached to a stiff, underlying material (13) containing still coarser perforation in the form of a plate or pipe provided with holes or ribs in a framework (31, FIG. 3) provided with large openings.

The suspension to be filtered or fractionated is conducted onto the screening foil through suitable pipes (21, FIG. 2) which are equipped with spray nozzles or slits (22) to disperse the suspension in a wide pattern (23) before the suspension liquid hits the screening foil (11).

The size of the perforation openings in the screen foil (11) determines for which solid particles in the suspensions are let through the openings and for which solid particles (24) are retained at the screening foil and which are continuously pushed away from the area (25) of the screening foil which is hit by the jet and where the filtrate is being hurled through the perforation openings due to the momentum of the jet (23).

Figure 3:
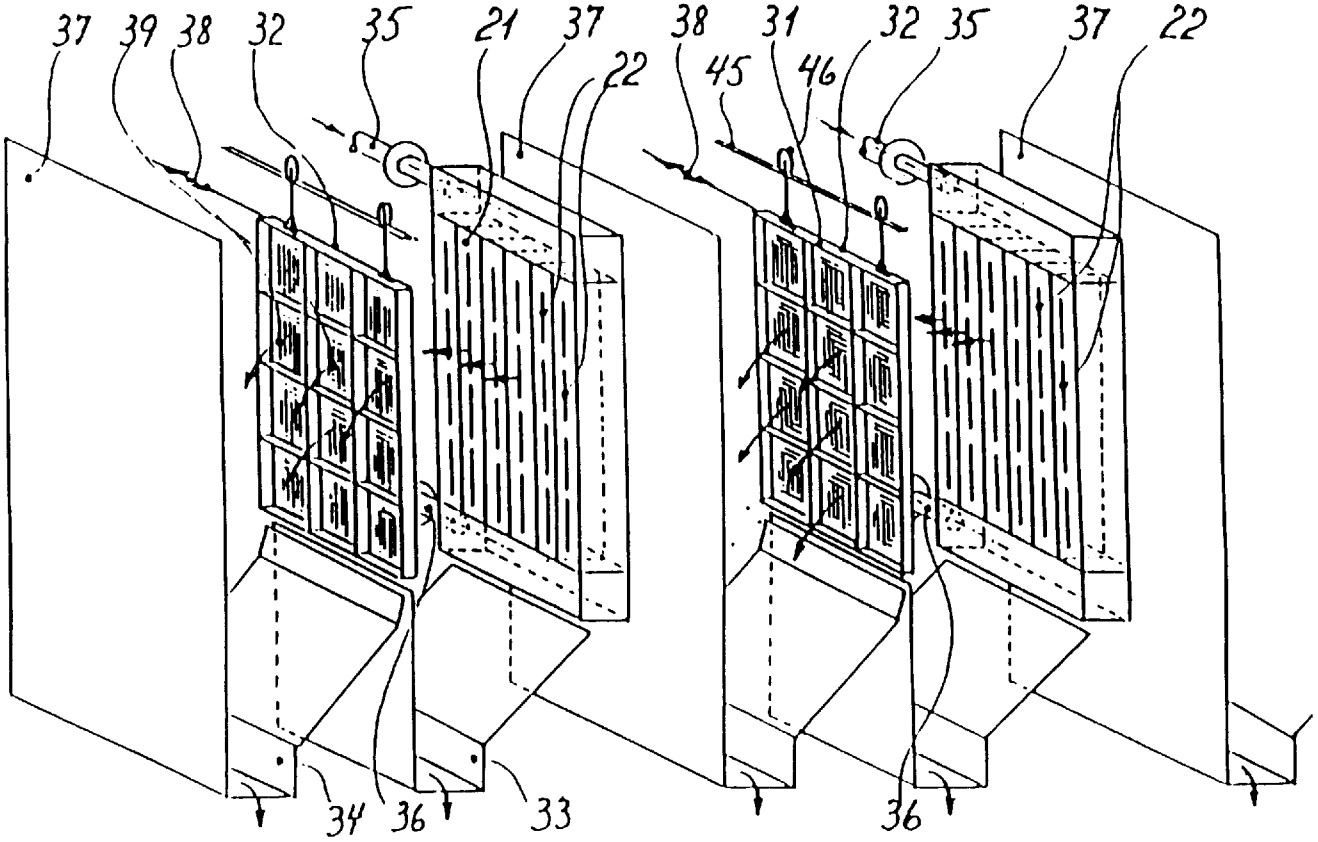
FIG. 3 illustrates the screening material as a plate.

The screening foil is preferably placed vertically in the screening apparatus, either in the form of standing plates (32, FIG. 3) or standing cylinders (41, FIG. 4) from where the separated particles (24, FIG. 2) on the screening foil can fall down between the row of spraying nozzles (22) and the jets (24) into a outlet device (33, FIG. 3),(51, FIG. 5) for separated particles, apart from the outlets of the filtrate (34) (52). The apparatus may consist of more plate sections as shown in FIG. 3 which contain respectively the screening foil (32) or the parallel, vertically placed jetpipes (21) which are packed together, and which at top and bottom are connected to the inlet pipes (35)(36) for the suspension, and thus placed together into groups, and where separated outlet devices (34)(33) respectively for filtrate and separated particles, are placed under these groups.

A plate (37) stops the filtrate after it has been hurled through the screening foil and leads the filtrate down to the outlet (34).

Figure 5:
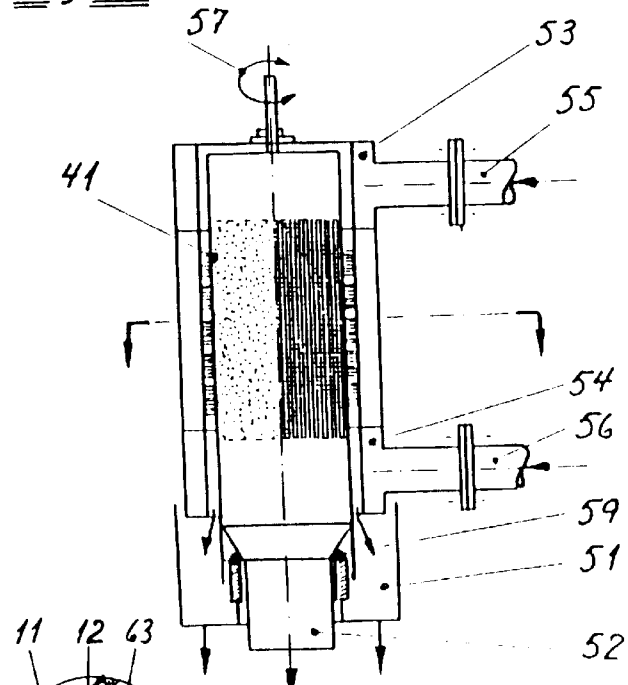
FIG. 5 illustrates the apparatus as a vertical standing cylinder
Figure 5A:
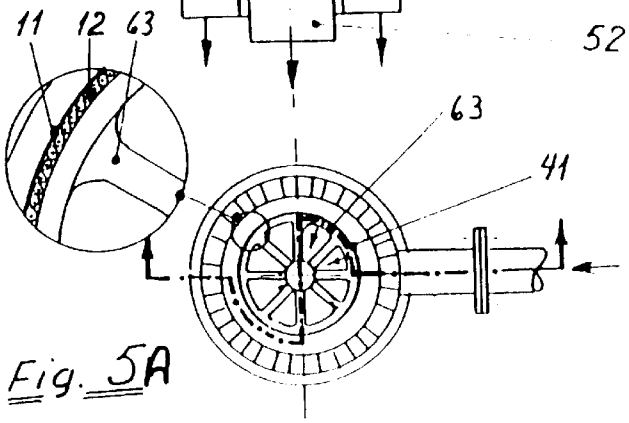
FIG. 5A illustrates the cross sectional view of the apparatus as a vertical standing cylinder.
Figure 4:
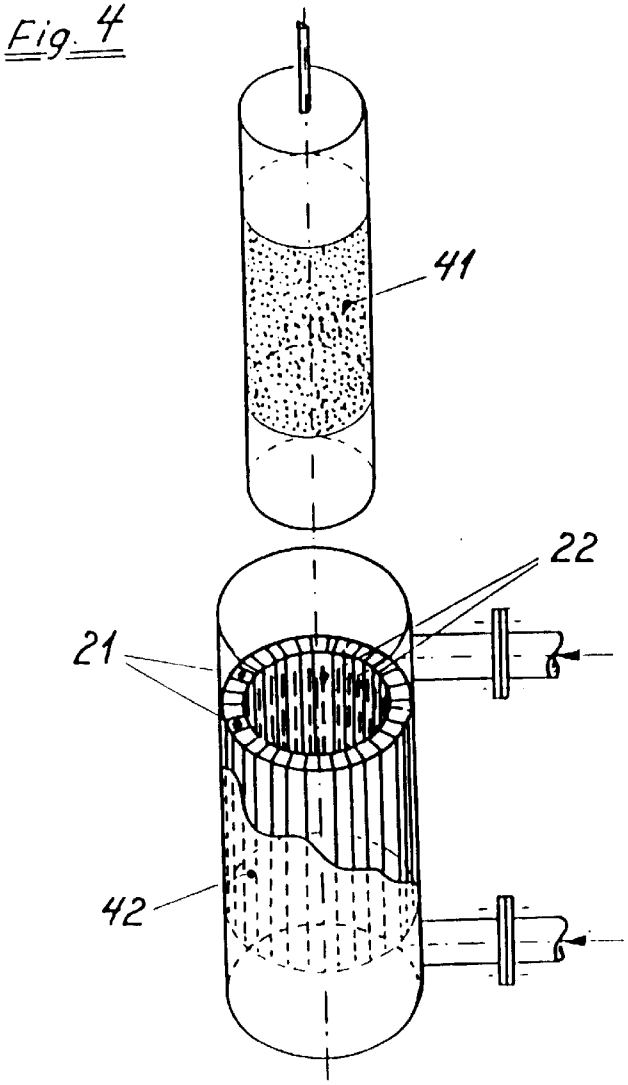
FIG. 4 illustrates the apparatus as a vertical standing cylinder.
Figure 7:
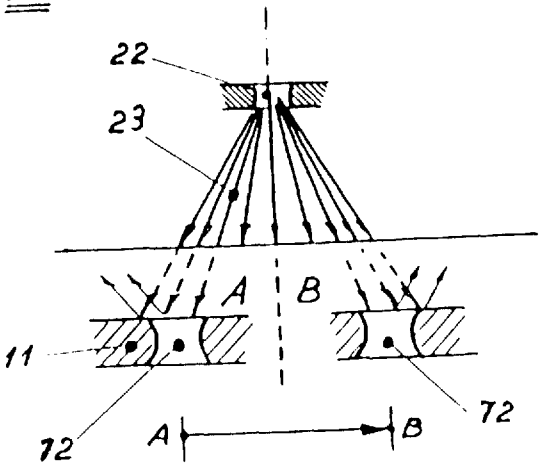
FIG. 7 illustrates a jet for spraying suspensions onto the screen.
Figure 8:
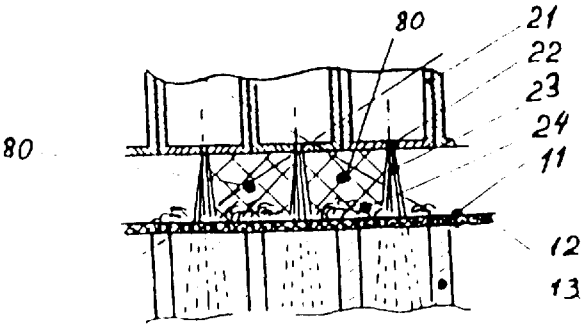
FIG. 8 illustrates the screening system of the present invention.
Figure 6:
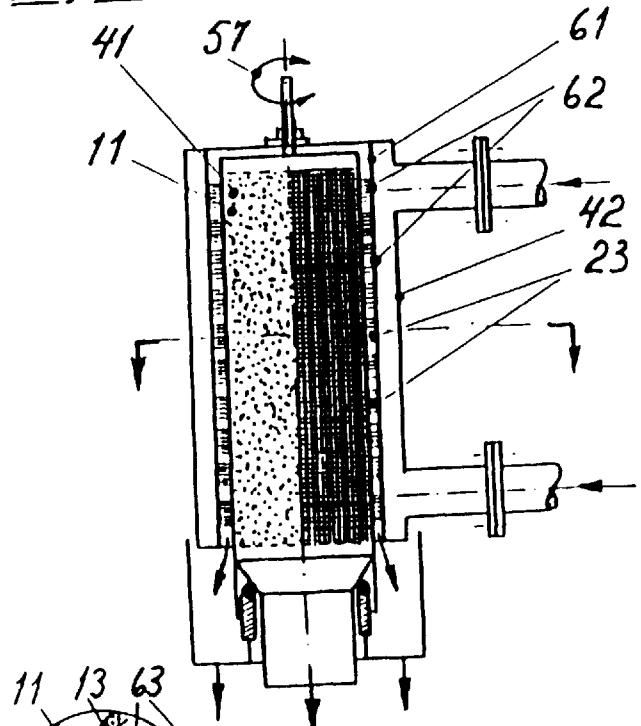
FIG. 6 illustrates the apparatus as a vertical standing cylinder.
Figure 6A:
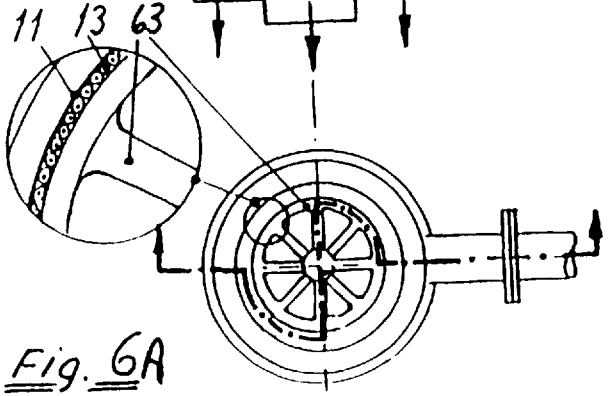
FIG. 6A illustrates the cross sectional view of the apparatus as a vertical standing cylinder.

FIG. 4, 5 and 6 show the apparatus formed as a vertical standing cylinder (41), placed within a tube jacket (42), inside of which is attached a pipe (21) with spray nozzles or slits (22) which communicate with a distribution chamber (53, FIG. 5) for suspension at top and bottom (54), and which is connected to the inlet pipes (55)(56) for suspension within the chambers.

Another form of performance is shown in FIG. 6, where the pipes with spray nozzles or slits are replaced with an inner tube jacket (61) which is provided with spray nozzles or slits (62) which spray suspension as jets (23) onto the inner cylinder (41) which is clad with the screening foil (11) over the underlying material (13), which further is attached to a framework (63). This arrangement eliminates the pipes for the spray nozzles and slits and the separated distribution chambers on top and bottom, as the volume between the inner tube jacket (61) and outer tube jacket (42) becomes one, integrated chamber of distribution for the suspension.

Also with this arrangement the filtrate and concentrate (separated, solid particles) leave the apparatus as described with respect to FIG. 5.

A device for oscillation (57), not shown in detail in the drawing, cause the direction of the ingoing jet (23, FIG. 7) for the screen openings (72) to be changed by the oscillation from position A to position B, which further cause the particles, which tend to clog the holes (72) in a position (A), to be hurled out of the opening again when the direction of the ingoing jet is changed by oscillation in the other, outer position (B).

5. MODE OF OPERATION

The suspension to be filtered or fractionated is put under pressure by a pump, nor shown on the drawings, and is conducted through spray nozzles or slits, which give the thus formed jets a certain widths, and whereby the pressure gives the jet a certain speed and momentum.

The suspension jet is moved at high speed, preferably exceeding 10 meters per second onto the screening foil, which preferably is arranged in a vertical position.

Dependant upon the suspension's consistencey, the size of the particles and perforation holes and the open area of the screening foil, a certain amount of the suspension is hurled through the openings of the screening foil (11) and thereafter continue through the coarse openings of the layers behind the screening foil (12)(13).

The screening foil retains those particles of the suspension which because of their size were not let through the perforation openings of the screening foil. These separated particles are continuously hurled out of the zone (25) on the screening foil which the suspension is sprayed onto, and form accumulations (24) of separated particles in the area between the jets.

By an open and non-pressurized construction of the screening apparatus, these accumulations will grow and then fall down due to accumulated weight, when the weight exceeds the adhesion forces between particles and screening material where the screening foil is placed vertically.

The oscillation device causes continuous purification of the screening foil (11) by moving the frames (31) with the screening foil (32) by a separate oscillation device (38), not shown in detail on FIG. 3, in front of the nozzles or slits, suspended by wheel rails (45) and rolls (46), or by g the nozzles or slits in a similar way in front of stationary screen plates, or by slightly moving the round cylinder (41, FIG. 4, 5 and 6) in both directions in the bearing (59) around its own axis by a separate device (57), not shown in detail on the drawings.

For both arrangements (FIG. 3, resp. FIG. 4, 5 and 6) the oscillation measures 2 to 3 times the distance between the row of nozzles or slits.

I claim:

1. An apparatus called "TSS"—or "The Turbo Screening System" which is a selfcleaning screening system for optimized filtering and fractionation of suspensions containing fibres, fibre fragments, fines and other particles without clogging of the screening material by the same elements, characterized in that the suspension to be filtered or fractionated is conducted under pressure through spray nozzles or slits (22) with high speed, exceeding 10 meters per second, onto a metallic screening material in a vertical position, the screen being formed as a flat plate or as a standing cylinder formed around a vertical axis, the screening material being a continuous, perforated and electrolytically produced metal foil (11), containing perforation openings which because of their geometrical configuration in combination with the applied strong movements of the suspension renders the screening system selfcleaning, the screening material containing opening diameters on the order or 10–100 $\mu$m, and with an open area on the order of 5% to 40% of the total area, and with a foil thickness in relation to hole diameter of 1:1 or 1,0–1,5:1, and whereby this screening foil is attached to a woven texture (12) of coarse, monofilament wires of synthetic material (plastics) or metal, which in its turn is attached to a plate or tube made out of synthetic material or metal provided with coarse, large holes or also attached to ribs (13) in a framework (31)(63), made out of the same materials.

2. An apparatus as claimed in claim 1, characterized in that round or flat suspension jets are being formed by spray nozzles or slits (22) in pipes (21), arranged in parallel rows with intermittent space for sorted out material.

3. An apparatus as claimed in claim 1 characterized in that the nozzles or slits (22) spray jets of suspension perpendicularly onto the screening metal foil (11), or with a deviation in relation to the perpendicular in the order of 5° to 30°.

4. An apparatus as claimed in claim 1 characterized in that the screening metal foil (11) is placed on flat, parallel planes onto which is sprayed suspension from more rows of nozzles or slits, whereby is separated filtrate (39) which is hurled through the screening metal foil (11), the wire texture (12) and the support (13), from the separated solid from the suspension (24) which is accumulated between the rows of nozzles or slits.

5. An apparatus as claimed in claim 1 characterized in that the screening metal foil is mounted as round cylinders (41) onto which is sprayed the suspension from more rows of nozzles or slits (22) which are mounted parallel to the cylinder axis, whereby is separated the filtrate (26), which is being hurled through the metal screen foil (11) and wire texture (12) and the supporting framework (63) from the separated solids (24) from the suspension which is accumulated between the rows of nozzles or slits.

6. An apparatus as claimed in claim 4 characterized in that the separated material (24) falls continuously down from the vertically mounted metal screening foil (31)(41) between the rows of nozzles or slits and conducted continuously out of the apparatus through separate outlets (33)(51).

7. An apparatus as claimed in claim 6, characterized in that separated solids (24) between the rows of jets by closed and pressurized construction is being pressed out of the apparatus due to the emerging pressure drop, and whereby the metal screening foil together with adjacent nozzles or slits also are placed inclined or horizontally within the apparatus, and whereby the metal screen foil (11), the suspension jets (23) and the pipe wall (21) for the nozzles or slits are forming the wall in channels (80) through which the separated solids are pressed out of the screening apparatus.

8. An apparatus as claimed in claim 1 characterized in that an oscillation device brings about a relative movement between the screening material (11) and the suspension jet (23) which in its turn cause the suspension jet to hit the perforation openings from shifting angles and thereby also cause a continuous cleansing of the metal screening foil.

* * * * *